US010053274B1

(12) United States Patent
O'Neill

(10) Patent No.: US 10,053,274 B1
(45) Date of Patent: Aug. 21, 2018

(54) PACKAGING AND DISPLAY APPARATUS

(71) Applicant: SUGARFINA, INC., Inglewood, CA (US)

(72) Inventor: Rosie Colleen O'Neill, Inglewood, CA (US)

(73) Assignee: SUGARFINA, INC., El Segundo, CA (US)

( * ) Notice: Subject to any disclaimer, the term of this patent is extended or adjusted under 35 U.S.C. 154(b) by 0 days.

(21) Appl. No.: 15/708,072

(22) Filed: Sep. 18, 2017

(51) Int. Cl.

| | |
|---|---|
| ***B65D 25/00*** | (2006.01) |
| ***B65D 79/00*** | (2006.01) |
| ***B65D 25/10*** | (2006.01) |
| ***B65D 77/26*** | (2006.01) |

(52) U.S. Cl.
CPC ..... *B65D 79/00* (2013.01); *B65D 25/10* (2013.01); *B65D 77/26* (2013.01)

(58) Field of Classification Search
USPC ..... 206/767, 768, 457, 459.5
See application file for complete search history.

(56) References Cited

U.S. PATENT DOCUMENTS

| | | | |
|---|---|---|---|
| 228,158 | A | 5/1880 | Woods |
| D36,435 | S | 7/1903 | Daggett |
| 1,162,840 | A | 12/1915 | Wood |
| 1,588,857 | A | 6/1926 | Sherman |
| D71,513 | S | 11/1926 | Austin |
| 1,620,789 | A | 3/1927 | Urban, Jr. |
| 1,697,880 | A | 1/1929 | Peter |
| 1,762,923 | A | 6/1930 | Fegely |
| D86,128 | S | 2/1932 | Levkoff |
| 1,871,617 | A | 8/1932 | King |
| 1,892,092 | A | 12/1932 | Barad |
| 1,899,547 | A | 2/1933 | Addis et al. |
| 1,994,159 | A | 3/1935 | Wurzburg |
| D95,429 | S | 4/1935 | James et al. |
| 2,511,211 | A | 6/1950 | Klein |
| 2,522,049 | A | 9/1950 | Lang |
| 2,541,173 | A | 2/1951 | Moore |
| 2,597,377 | A | 5/1952 | Robinson |
| 2,604,980 | A | 7/1952 | Reid |
| 2,751,135 | A | 6/1956 | Kessler |

(Continued)

FOREIGN PATENT DOCUMENTS

| | | | |
|---|---|---|---|
| EP | 2042439 | A1 | 4/2009 |
| WO | 2017125444 | A1 | 7/2017 |

OTHER PUBLICATIONS

Chocomize, Candy Cube Boxes, www.chocomize.com/candy-cube-box-9pc.html (Jun. 29, 2017).

(Continued)

*Primary Examiner* — Jacob K Ackun
(74) *Attorney, Agent, or Firm* — Troutman Sanders LLP; Alexis N. Simpson; Micah B. Hensley

(57) ABSTRACT

The disclosed technology can include, in some embodiments, a packaging and display system comprising a box, a flap connected to the box, a pop-up portion hingedly connected to the box, a connector member hingedly connected to both the flap and the pop-up portion, and a drawer configured to at least partially insert into the box. In certain embodiments, the packaging and display system can comprise an object, and in some embodiments, the drawer can include a cutout configured to at least partially receive the object.

19 Claims, 8 Drawing Sheets

(56) References Cited

U.S. PATENT DOCUMENTS 2,782,951 A 2/1957 Inman
2,790,589 A 4/1957 Moore
3,004,661 A 10/1961 Schumann
3,126,093 A 3/1964 Bradley et al.
3,357,543 A 12/1967 Taggart
3,423,006 A 1/1969 Stedman
3,494,534 A 2/1970 McFarland et al.
3,600,871 A 8/1971 Farquhar
3,660,934 A 5/1972 Pollack et al.
D242,771 S 12/1976 Papillon
D244,085 S 4/1977 Giddings et al.
4,139,096 A 2/1979 Sieger
D258,938 S 4/1981 Spitzer
4,293,079 A 10/1981 Lytle
D292,876 S 11/1987 Grunhut
D292,877 S 11/1987 Grunhut
4,713,928 A 12/1987 Tisma
4,757,898 A 7/1988 Klein
D307,504 S 4/1990 Silcox
D315,297 S 3/1991 Campbell
D317,717 S 6/1991 Carol
D317,718 S 6/1991 Carol
5,038,940 A 8/1991 Okabe
5,096,056 A 3/1992 Garcia
5,104,124 A 4/1992 Bernard
D327,004 S 6/1992 Nadel
D329,601 S 9/1992 Samelson
D333,615 S 3/1993 Zutler
D335,819 S 5/1993 Campbell
D344,020 S 2/1994 Pavely
5,375,706 A 12/1994 Perez
D361,508 S 8/1995 Schnack
D361,661 S 8/1995 Masuda
D373,723 S 9/1996 Healey
5,555,982 A 9/1996 Kuhn et al.
5,590,786 A 1/1997 Jaycox
5,603,558 A 2/1997 Zimmer
D380,417 S 7/1997 Hardy
D380,926 S 7/1997 Goodburn et al.
5,682,999 A 11/1997 Larson
5,738,221 A * 4/1998 Van Witt ..... G11B 23/40 206/308.1
5,791,468 A 8/1998 House
5,817,510 A 10/1998 Pandey et al.
D411,308 S 6/1999 Pandey et al.
D424,296 S 5/2000 David
D424,425 S 5/2000 Ngai
D426,902 S 6/2000 Hardy et al.
D433,630 S 11/2000 Lubineau-Bigot et al.
6,349,820 B1 2/2002 Kelley et al.
D455,073 S 4/2002 Mizrahi
D464,568 S 10/2002 Sisinni
D464,885 S 10/2002 Weinstein et al.
D468,100 S 1/2003 Bowling
6,533,166 B1 3/2003 Kaiss
D477,911 S 8/2003 Stuart
D492,194 S 6/2004 Kim
D494,862 S 8/2004 Sisinni
6,923,556 B1 8/2005 Baker, III
D510,528 S 10/2005 Funk
D511,681 S 11/2005 Cogley et al.
D521,733 S 5/2006 Kim
D522,376 S 6/2006 Hales
D528,794 S 9/2006 Lanham et al.
D536,246 S 2/2007 Schneider
7,264,123 B2 9/2007 Reed
D553,495 S 10/2007 Vandecasteele et al.
D568,765 S 5/2008 Miles
D580,263 S 11/2008 Yi Man
D584,053 S 1/2009 Abdo et al.
D596,485 S 7/2009 Andre et al.
D603,720 S 11/2009 Cesare et al.
D609,116 S 2/2010 Kim
7,757,843 B2 7/2010 Katsis
D621,548 S 8/2010 Chen
D643,306 S 8/2011 Martinez et al.
8,006,842 B1 8/2011 Loughlin, Jr. et al.
D646,984 S 10/2011 Moore et al.
8,109,389 B1 2/2012 Amer
D657,284 S 4/2012 Young
D663,520 S 7/2012 Antler
D664,312 S 7/2012 Bizzle
8,272,509 B1 9/2012 McCutchen
D669,352 S 10/2012 Paslawski
D670,931 S 11/2012 Tapper
D670,932 S 11/2012 Tapper
D673,864 S 1/2013 Read et al.
D675,539 S 2/2013 Bilgarians
D682,119 S 5/2013 Buford
D685,578 S 7/2013 Pestell
D686,065 S 7/2013 Kuo et al.
D686,491 S 7/2013 Kuo et al.
D687,321 S 8/2013 Pralus
D690,554 S 10/2013 Presley
D691,465 S 10/2013 O'Brien et al.
D691,900 S 10/2013 Kraus
D698,639 S 2/2014 Fletcher et al.
D698,664 S 2/2014 Abbott
D700,462 S 3/2014 Boos
D704,550 S 5/2014 Mattila et al.
D706,627 S 6/2014 Olsson et al.
D709,305 S 7/2014 Tapper
D709,306 S 7/2014 Tapper
D709,364 S 7/2014 Olsson et al.
D712,176 S 9/2014 Tamilarasan
D712,748 S 9/2014 Akana et al.
D713,739 S 9/2014 Akana et al.
D717,165 S 11/2014 Kwak et al.
D722,870 S 2/2015 Fohner et al.
D728,358 S 5/2015 Belamich
D729,636 S 5/2015 Steinberger
D730,749 S 6/2015 Young et al.
D731,323 S 6/2015 O'Neill
D731,325 S 6/2015 Loessin
D733,314 S 6/2015 Lui
D733,315 S 6/2015 Lui
D733,317 S 6/2015 Lui
D733,318 S 6/2015 Lui
9,061,790 B2 6/2015 Yagishita
D734,075 S 7/2015 Tapper
D738,721 S 9/2015 Song et al.
D741,193 S 10/2015 Lohuis et al.
D748,280 S 1/2016 Lui
D754,408 S 4/2016 Garrett et al.
D755,641 S 5/2016 O'Neill
D756,560 S 5/2016 Ghiotti et al.
D756,804 S 5/2016 Gross
D758,191 S 6/2016 Tu et al.
D763,104 S 8/2016 Akana et al.
D763,683 S 8/2016 O'Neill
D763,684 S 8/2016 O'Neill
D764,911 S 8/2016 Glass et al.
D768,008 S 10/2016 Akana et al.
D769,727 S 10/2016 Lohuis et al.
D769,986 S 10/2016 Timg
D772,057 S 11/2016 Adams et al.
D774,388 S 12/2016 Xia
9,533,791 B2 1/2017 Fath
D780,569 S 3/2017 Bard et al.
D780,570 S 3/2017 Bard et al.
D787,186 S 5/2017 Thurbin
D787,320 S 5/2017 Gill et al.
D789,752 S 6/2017 Zmrhal et al.
2002/0108880 A1 8/2002 Krupa et al.
2006/0266672 A1 11/2006 Young
2006/0283733 A1 12/2006 Masa
2007/0095693 A1 5/2007 DeLuca
2008/0190788 A1 8/2008 Cziraky
2009/0242455 A1 10/2009 Adams et al.
2010/0012672 A1 1/2010 Piron
2010/0187227 A1 7/2010 Wang
2011/0174166 A1 7/2011 Sparacio et al.
2012/0168434 A1 7/2012 Algarda Cervera et al.
2012/0168443 A1 7/2012 Maness

(56) References Cited

U.S. PATENT DOCUMENTS

| | | | | |
|---|---|---|---|---|
| 2013/0161378 | A1 | 6/2013 | Nebeker et al. | |
| 2013/0220880 | A1* | 8/2013 | Glass | B65D 5/38 206/767 |
| 2013/0240387 | A1 | 9/2013 | Pugh | |
| 2013/0248531 | A1 | 9/2013 | Lane | |
| 2014/0021086 | A1 | 1/2014 | Roesler | |
| 2014/0166736 | A1 | 6/2014 | Kato | |
| 2014/0312107 | A1 | 10/2014 | Nash | |
| 2015/0093509 | A1 | 4/2015 | Kennedy et al. | |
| 2015/0232245 | A1 | 8/2015 | Fullan | |
| 2015/0321811 | A1 | 11/2015 | Yeung | |
| 2016/0009473 | A1 | 1/2016 | Korinek et al. | |
| 2016/0046404 | A1 | 2/2016 | Cheeser et al. | |
| 2016/0185511 | A1 | 6/2016 | O'Neill | |
| 2017/0050797 | A1 | 2/2017 | Farid et al. | |
| 2017/0076343 | A1 | 3/2017 | Bernstein et al. | |
| 2017/0138660 | A1 | 5/2017 | Huckaby et al. | |
| 2017/0152092 | A1 | 6/2017 | Glass et al. | |

OTHER PUBLICATIONS

MidNite Snax, Signature Sets, http://midnitesnax.com/home_page_files/view/1265/file.pdf (Jun. 29, 2017).
Sweet Pete's, Build-a-Candy-Cube-Box, https://www.sweetpetescandy.com/collections/build-a-candy-cube-box (Jun. 29, 2017).
Sweet Pete's, Pete's Picks Collection, www.sweetpetescandy.com:80/collections/boxes (Mar. 23, 2016).
Sweitzer Candy Shop, Gifts, https://sweitzercandy.com/index.php/gift-boxes.html (Jun. 29, 2017).
Sugarfina, Design Your Own Bento, www.sugarfina.com/shop/gift-shop/gift-type/design-your-own-bento (Jun. 29, 2017).
Sugarfina, Custom Catalogue, https://issuu.com/sugarfina/docs/2017-corporatecatalog-ppai-webversi (Jun. 29, 2017).
Teaspressa, Tea + Cube, available at https://teapressa.com/collections/gifts/products/tea-cube (Jun. 29, 2017).
Sweitzer Candy Gift Box 8, available Feb. 21, 2015, [online], [site visited Aug. 2, 2017]. Available from internet, <URL: https://web.archive.org/web/20150221225755/https://sweitzercandy.com/index.php/gift-boxes.html, 2 pages.
Sweitzer Candy Gift Box 4, available Feb. 21, 2015, [online], [site visited Aug. 2, 2017]. Available from internet, <URL: https://web.archive.org/web/20150221225755/https://sweitzercandy.com/index.php/gift-boxes.html, 2 pages.
"A Taste of Paradise," Collection by Sugarfina, available Aug. 2, 2017, [online], [site visited Aug. 2, 2017]. Available from internet, <URL:https://www.sugarfina.com, 1 page.
Cubetas, [online], [site visited Aug. 16, 2017]. Available from internet, <URL:http://cubetas.jp/>, 19 pages.
Sugarfina Partners With Sanrio to Create the Cutest Hello Kitty Candy on the Planet. [online] Published Sep. 17, 2017. Retrieved Nov. 20, 2017 from URL: https://www.popsugar.com/food/photo-gallery/44018877/image/44018885/Sugarfinas-Pop-Up-Candy-Bento-Box-30.
Rigid Set-up Box, Wine and Champagne Chocolate Leather Gift Box, Faux Leather, Dark Brown, Qty/CASE-6. [online] Retrieved Nov. 22, 2017 from URL: https://www.aspecialtybox.com/RG00F-00493-C.
House Drawer Gift Box/CMXSSGB-10. [online] Retrieved Nov. 22, 2017 from URL: http://www.charmpackaging.com/special-shape-gift-box/house-drawer-gift-box-cmxssgb-010.html.
Bouquet Bar 3 Piece Box Photo—Instagram—https://www.instagram.com/p/BPs-h6rBWic/?taken-by=thebouquetbar; Jan. 25, 2017, 1 page.
Bouquet Bar 6 Piece Box Photo—"It's Time to Ditch the Red Roses: Six Better Ways to Give Your Valentine Flowers," People Home & Travel; Jan. 31, 2017, 10 pages.
Bouquet Bar 6 Piece Photo—Instagram—https://www.instagram.com/p/BP-9l12hV9Q/?taken-by=thebouquetbar; Feb. 1, 2017, 1 page.
Chocomize 2 Piece Box—https://www.chocomize.com/candy-cubes-2pack.html; Oct. 16, 2017, 4 pages.
Chocomize 3 Piece Box Photo—Facebook—https://www.facebook.com/Chocomize/photos/a.423529781180.220124.176532311180/10154561729211181/?type=3&theater; Nov. 11, 2016, 1 page.
Chocomize 6 Piece Box—https://www.chocomize.com/candy-cube-6pcs-box.html; Oct. 16, 2017, 3 pages.
Chocomize 9 Piece Box Photo—Instagram—https://www.instagram.com/p/BI5r4s6BLH7/?taken-by=chocomize; Aug. 9, 2016, 1 page.
Chocomize 9 Piece Box Photo—Instagram—https://www.instagram.com/p/BMpjEEUhpqV/?taken-by=chocomize; Nov. 10, 2016, 1 page.
Chocomize 9 Piece Box Photo—Instagram—https://www.instagram.com/p/BMrp0YdhQeU/?taken-by=chocomize; Nov. 11, 2016, 1 page.
Cubetas 2 Piece and 3 Piece Box Photo—Instagram—https://www.instagram.com/p/BMyWwq0BQoH/?taken-by=cubetas.2016; Nov. 14, 2016, 1 page.
Cubetas 2 Piece and 3 Piece Box Photo—Instagram—https://www.instagram.com/p/BNtkhJpBzYm/?taken -by=cubetas.2016; Dec. 7, 2016, 1 page.
Cubetas 2 Piece Box Photo—Instagram—https://www.instagram.com/p/BMQ9Bjihqyz/?taken-by=cubetas.2016; Nov. 1, 2016, 1 page.
Cubetas 3 Piece Box Photo—Instagram—https://www.instagram.com/p/BPrxqTThloh/?taken-by=cubetas.2016; Jan. 25, 2017, 1 page.
Foxes Events 6 Piece Box Photo—Instagram—https://www.instagram.com/p/BQVMWj7jZke/?taken-by=foxesevents&hl=en; Feb. 10, 2017, 1 page.
Idea Stage 2 Piece Box—https://www.ideastage.com/Cube-Shaped-Candy-Set-965458328; Oct. 13, 2017, 2 pages.
Sugarwish 2 Piece and 4 Piece Boxes—https://web.archive.org/web/20151201071311/https:/sugarwish.com/choose-a-sugarwish; Dec. 1, 2015, 1 page.
Sweet Lounge 2 Piece Box—https://www.sweetlounge.co.uk/lounge-box-hello-spring-collection-for-vegans/; Oct. 16, 2017, 6 pages.
Sweet Lounge 3 Piece and 4 Piece Box Photo—Instagram—https://www.instagram.com/p/BM_eHn6g8ly/?taken-by=sweetloungeuk; Nov. 19, 2016, 1 page.
Sweet Lounge 3 Piece and 4 Piece Box Photo—Instagram—https://www.instagram.com/p/BMY_iidAMwX/?taken-by=sweetloungeuk; Nov. 4, 2016, 1 page.
Sweet Lounge 4 Piece Box—Instagram—https://www.instagram.com/p/BNMnfaJgwOo/?taken-by=sweetloungeuk; Nov. 24, 2016, 1 page.
Sweet Lounge 4 Piece Box—https://www.sweetlounge.co.uk/lounge-box-hello-spring-collection/; Oct. 16, 2017, 7 pages.
Sweet Lounge 4 Piece Box Video Snapshots—Facebook—https://www.facebook.com/sweetloungeuk/videos/vb.670728213008752/1188285557919679/?type=2&theater; Nov. 16, 2016, 6 pages.
Sweet Pete's 8 Piece Box—www.sweetpetescandy.com/collections/create-a-box; Nov. 18, 2016, 2 pages.
Sweitzer Candy 3 Piece Box Photo—Instagram—https://www.instagram.com/p/440XveluqO/?taken-by=sweitzercandy; Jul. 8, 2015, 1 page.
Sweitzer Candy 4 Piece Box Photo—Instagram—https://www.instagram.com/p/440XveluqO/?taken-by=sweitzercandy; Apr. 16, 2015, 1 page.
Sweitzer Candy 8 Piece Box Photo—Instagram—https://www.instagram.com/p/wLDm8Olujs/?taken-by=sweitzercandy; Dec. 4, 2014, 1 page.
Webb Company 2 Piece Box Photo—Facebook—https://www.facebook.com/webbcollection/photos/a.376918812240.156708.376836382240/10154628557212241/?type=3&theater; Oct. 18, 2016, 1 page.
Webb Company 4 Piece Box—https://www.facebook.com/webbcollection/photos/a.376918812240.156708.376836382240/10154602255037241/?type=3&theater; Oct. 11, 2016, 1 page.
Weeny Beeny 3 Piece Box Photo—Facebook—https://www.facebook.com/weenybeeny123/; Jan. 31, 2017, 1 page.

(56) References Cited

OTHER PUBLICATIONS

Weeny Beeny 4 Piece Box Photo—Facebook—https://www.facebook.com/weenybeeny123/; Jan. 31, 2017, 1 page.
Bonbonist Box Photo—Facebook—https://www.facebook.com/thebonbonist/photos/a.1493876617357861.1073741829.1290401221038736/1493876580691198/?type=3&theater; Oct. 1, 2017, 1 page.
Bonbonist—https://thebonbonist.com/; Oct. 18, 2017, 4 pages.
International Search Report and Written Opinion for International Application No. PCT/US2017/057660 dated Jan. 25, 2018, 9 pages.
International Search Report and Written Opinion for International Application No. PCT/US2017/057660 dated Jan. 25, 2018, 8 pages.
Beach Picnic Image (Date Unknown), 1 page.
Sugarfina Representative Twitter posts; https://twitter.com/sugarfina; 8 pages.
Sugarfina Representative Facebook posts; https://www.facebook.com/Sugarfina; 25 pages.
Sugarfina Representative Instagram posts; https://www.instagram.com/sugarfina/?hl=en; 40 pages.
Sugarfina: Sampling the Sweets—York Avenue; https://yorkavenueblog.com/sugarfina-sampling-sweets/; Sep. 8, 2014; 7 pages.
Sugarfina—Candy Happiness!; http://luluandlattes.com/2013/06/27/sugarfina-candy-happiness/; Jun. 27, 2013; 11 pages.
Kasey's Kitchen: Kasey's Favorite Thing #20: Sugarfina; http://kaseyskitchentv.blogspot.com/2013/12/kaseys-favorite -thing-20-sugarfina.html; Dec. 17, 2013; 3 pages.
Jonathan Adler Sugarfina Bento Boxes_InStyle.com; http://www.instyle.com/lifestyle/news/sugarfina-loves-jonathan-adler-collection; Apr. 11, 2016; 2 pages.
Fancy candy brand selects fancier Dallas destination for Texas debut; http://dallas.culturemap.com/news/restaurants-bars/10-29-15-sugarfina-highland-park-village-market-candy/; Oct. 29, 2015; 4 pages.
Emiiichan Blog_Sugarfina candy order; https://emiiichan.blogspot.com/2014/11/sugarfina-candy-order.html; Nov. 21, 2014, 18 pages.
Drool Worthy Sweets in Cute Packaging Beckon at Sugarfina Candy Shop; http://www.7x7.com/drool-worthy-sweets-in-cute-packaging-beckon-at-sugarfina-candy-shop-1787196138.html; Jul. 15, 2015; 4 pages.
Candy Critic:Boxes and Boxes of Gummies From Sugarfina; http://candy-critic.blogspot.com/2013/05/boxes-and-boxes-of-gummies-from.html; May 2, 2013; 2 pages.
Sugarfina Part I—Foodette Reviews; http://foodettereviews.com/?p=24; Sep. 10, 2013; 7 pages.
Rebecca's Delights: Sugarfina Gourmet Candy—Author Rebecca Kelsey Sampson; http://rebeccakelsey.com/2012/11/rebeccas-delights-sugarfina-gourmet-candy; Nov. 12, 2012; 6 pages.
Sugar & Charm // Sugarfina—Mary Costa Photography; http://marycostaphotography.com/sugar-charm-sugarfina/; Apr. 22, 2014; 24 pages.
Treat yourself: SUGARFINA!_Twinkie Chan Blog; http://blog.twinkiechan.com/2012/09/20/treat-yourself-sugarfina/; Sep. 20, 2012; 13 pages.
Sugarfina << MDH Mark D Hogan; https://markdhogan.wordpress.com/tag/sugarfina/; Aug. 29, 2013; 7 pages.
Sugarfina (Beverly Hills, CA) • The Episodic Eater; https://www.theepisodiceater.com/sugarfina-beverly-hills-ca/; unknown date; 29 pages.
Sugarfina—A Unique Candy Boutique at the Americana; http://www.realmomofsfv.com/2014/06/18/sugarfina-a-unique-candy-boutique-at-the-americana/; Jun. 18, 2014; 28 pages.
Sugarfina—Thrillist LA; https://www.thrillist.com/eat/los-angeles/we-fed-a-kid-absinthe-candy-here-s-what-happened-thrillist-la; Dec. 16, 2013; 35 pages.
A Sweet Evening at Sugarfina—SavvySleepers; https://www.savvysleepers.com/blogs/the-benefits-of-satin/44181636-a-sweet-evening-at-sugarfina; Aug. 31, 2015; 7 pages.
Sugarfina: The Chocolates—Candy Blog; http://www.candyblog.net/blog/item/sugarfina_the_chocolates; Jul. 16, 2013; 11 pages.
Sugarfina Bevery Hills & Trio of Goodies—Candy Blog; http://www.candyblog.net/blog/item/sugarfina_trio_of_goodies; Dec. 16, 2013; 11 pages.
Sugarfina: The Gummis—Candy Blog; http://www.candyblog.net/blog/item/sugarfina_the_gummis; Jul. 10, 2013; 11 pages.
NYC Guide: Sugarfina—York Avenue; https://yorkavenueblog.com/nyc-guide-sugarfina/; Oct. 26, 2015; 74 pages.
Talking Shop: Sugarfina—Sugar Paper; https://sugarpaper.com/blogs/news/87503553-talking-shop-sugarfina; Feb. 11, 2016; 13 pages.
A Candy Emporium for Adults; https://www.entrepreneur.com/article/236286; Aug. 25, 2014; 10 pages.
10 fanciest candies from Sugarfina's New York shop—NY; http://www.nydailynews.com/life-style/eats/10-fanciest-candies-sugarfina-new-york-shop-article-1.2407237; Oct. 22, 2015; 9 pages.
People Freaked Out So Hard Trying to Get Rosé Gummy Bears that They Crashed the Website; https://www.forbes.com/sites/meghancasserly/2013/04/09/sugarfina-facebook-candy-shop-outerspace/#78cb39dd6e74; Jun. 29, 2016; 14 pages.
Sugarfina: One Candy-Coated Startup's Plans for a Lucrative Exit—But First a Trip to Space; https://www.forbes.com/sites/meghancasserly/2013/04/09/sugarfina-facebook-candy-shop-outerspace/#78cb39dd6e74; Apr. 9, 2013; 6 pages.
Luxurious One-of-a-Kind Candy Shop Tour With Sugarfina—Best Friends for Frosting; https://bestfriendsforfrosting.com/2015/11/luxurious-one-kind-candy-sugarfina/; Nov. 17, 2015; 16 pages.
Sugarfina Launches—Atlanta's Lenox Square Just Got Sweeter!; http://www.momsmagicalmiles.com/sugarfina-launches-atlantas-lenox/; Nov. 6, 2015; 15 pages.
Whispering Angel Rosé-Infused Gummy Bears are Summer's Hottest Sweet—The Glamorous Gourmet; https://theglamorousgourmet.com/whispering-angel-rose-gummy-bears-summers-hottest-sweet/; Jul. 31, 2016; 13 pages.
Sugar Fix: Sugarfina Pasadena; https://studiodiy.com/2015/07/21/sugar-fix-sugarfina-pasadena/; Jul. 21, 2015; 15 pages.
Rosie O'Neill of Sugarfina—The Everygirl; http://theeverygirl.com/rosie-oneill-of-sugarfina; May 18, 2014; 27 pages.
White Two Piece Gift Box (Exact Date Unknown); believed available as of Aug. 2012; 1 page.
Colored Deluxe Two Piece Gift Boxes (Exact Date Unknown); believed available as of Aug. 2012; 10 pages.
Clear Flush-Lid Amac Boxes (Exact Date Unknown); believed available as of Feb. 27, 2010; 10 pages.

* cited by examiner

PACKAGING AND DISPLAY APPARATUS

BACKGROUND

Packaging of a product can be a direct pathway to impress customers and potential customers. Accordingly, product packaging can provide unique marketing opportunities for merchants and manufacturers. Many products can be packaged and sold in boxes, containers, or similar packaging. Product packaging can also provide a means in which to present an item to customers. But existing product packaging overlook or fail to take advantage of an opportunity in which to engage customers and/or potential customers, which may provide increased customer interest in an item.

Therefore, there is a need for a packaging and display apparatus designed to engage customers. There is also a need for a packaging and display apparatus designed to aesthetically present a theme, such as a marketing theme.

SUMMARY

Aspects of the present disclosure provide a container system. According to some embodiments, a container system can comprise a container comprising a front face, and the front face can comprise an aperture. The container system can also comprise a flap hingedly connected to the container and a pop-up portion hingedly connected to the container, and the pop-up portion can be in communication with the flap such that the pop-up portion can be caused to pivot as the flap pivots. The container system can comprise a drawer that comprises an insert, the insert can comprise a cutout, and the cutout can extend at least partially into the insert. The aperture can be configured to at least partially receive the drawer.

In some embodiments, the container system can comprise an object, and the cutout can be configured to at least partially receive the object.

In some embodiments, the cutout can be a first cutout, and the drawer can further comprise a second cutout that extends at least partially into the insert.

In some embodiments, the container system can comprise a first object and a second object. The first cutout can be configured to at least partially receive the first object, and the second cutout can be configured to at least partially receive the second object.

In some embodiments, the pop-up portion can be hingedly connected to a top surface of the container, and the flap can be hingedly connected proximate a top-rear edge of the container.

In some embodiments, the flap can have a first portion dimensioned to substantially complement the top surface of the container and a second portion dimensioned to substantially complement a front face of the container, and the second portion can be configured to hinge relative to the first portion.

In some embodiments, the container system can comprise a latching mechanism configured to detachably attach the second portion of the flap to a front side of the drawer.

In some embodiments, the container system can comprise a latching mechanism configured to detachably attach the second portion of the flap to the front face of the container.

In some embodiments, the flap and the pop-up portion can be configured to hinge between a storage configuration and a display configuration. When in the storage configuration, the flap and the pop-up portion can be hinged such that at least one of the pop-up portion and the flap are substantially parallel to a top surface of the container, and when in the display configuration, the flap and the pop-up portion can be hinged such that at least one of the pop-up portion and the flap are not substantially parallel to the top surface.

In some embodiments, the container system can comprise a stop mechanism that can be configured to prevent rotation of the flap and/or the pop-up portion beyond a maximum angle.

In some embodiments, the flap can comprise a first portion dimensioned to substantially complement the top surface of the container and a second portion dimensioned to substantially complement the front face of the container. The second portion can be configured to hinge relative to the first portion and can comprise a first magnet. A front side of the drawer can comprise comprises a second magnet, and the first magnet and the second magnet can be positioned to substantially align when the container system is in the storage configuration.

In some embodiments, at least one of the drawer and the flap can comprise a tab.

In some embodiments, the container system can comprise an image located on an exterior surface of the container, and the image can be topically related to the pop-up portion.

According to some embodiments, a packaging and display system can comprise a box that can comprise a top, a bottom, two opposing sides, a back, and an open face. The packaging and display system can also comprise a flap hingedly connected to the box proximate an edge formed by the top and the back, such that the flap can pivot between a closed position in which the flap is substantially parallel to the top and an open position. The packaging and display system can also comprise pop-up portion hingedly connected to the top, a connector member hingedly attached to a back side of the pop-up portion and hingedly connected to a bottom side of the flap, and a drawer configured to at least partially insert into the open face. The drawer can comprise a cutout.

In some embodiments, the drawer can comprise an insert, and the insert can comprise the cutout.

In some embodiments, the pop-up portion can be hingedly connected to the top at a first position, the flap can be hingedly connected to the box at a second position, and the first position can be a distance from the second position. The connector member can have a length, and the distance can be approximately equal to the length.

In some embodiments, the packaging and display system can comprise an image, and the image can be topically related to the pop-up portion.

In some embodiments, the packaging and display system can comprise an object, and the cutout can be configured to at least partially receive the object.

In some embodiments, the cutout can be a first cutout, and the drawer can further comprise a second cutout.

In some embodiments, the packaging and display system can comprise a first object and a second object, the first cutout can be configured to at least partially receive the first object, and the second cutout can be configured to at least partially receive the second object.

BRIEF DESCRIPTION OF THE DRAWINGS

Reference will now be made to the accompanying figures, which are not necessarily drawn to scale, and wherein.

DETAILED DESCRIPTION

Figure 1:
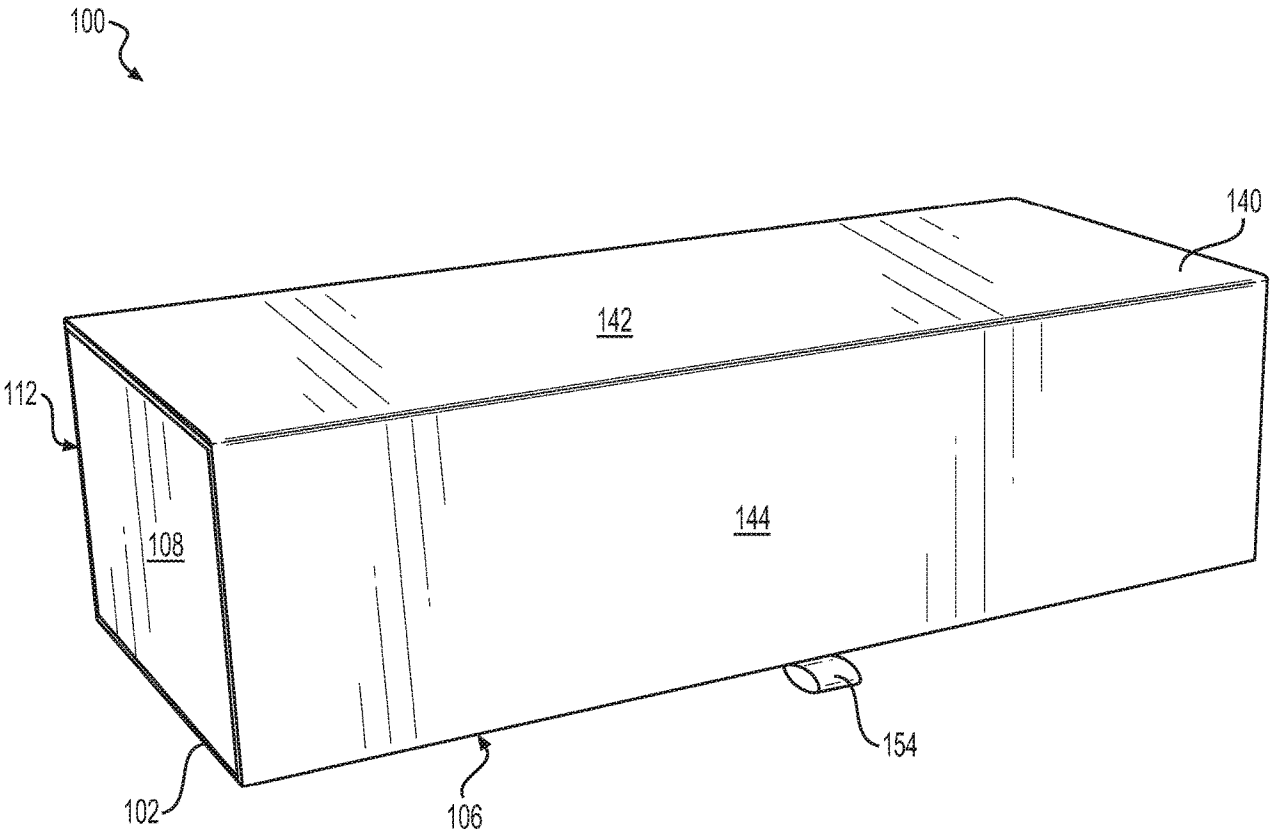
FIG. 1 shows a packaging and display system in a closed configuration, in accordance with an example embodiment of the presently disclosed subject matter.
Figure 2:
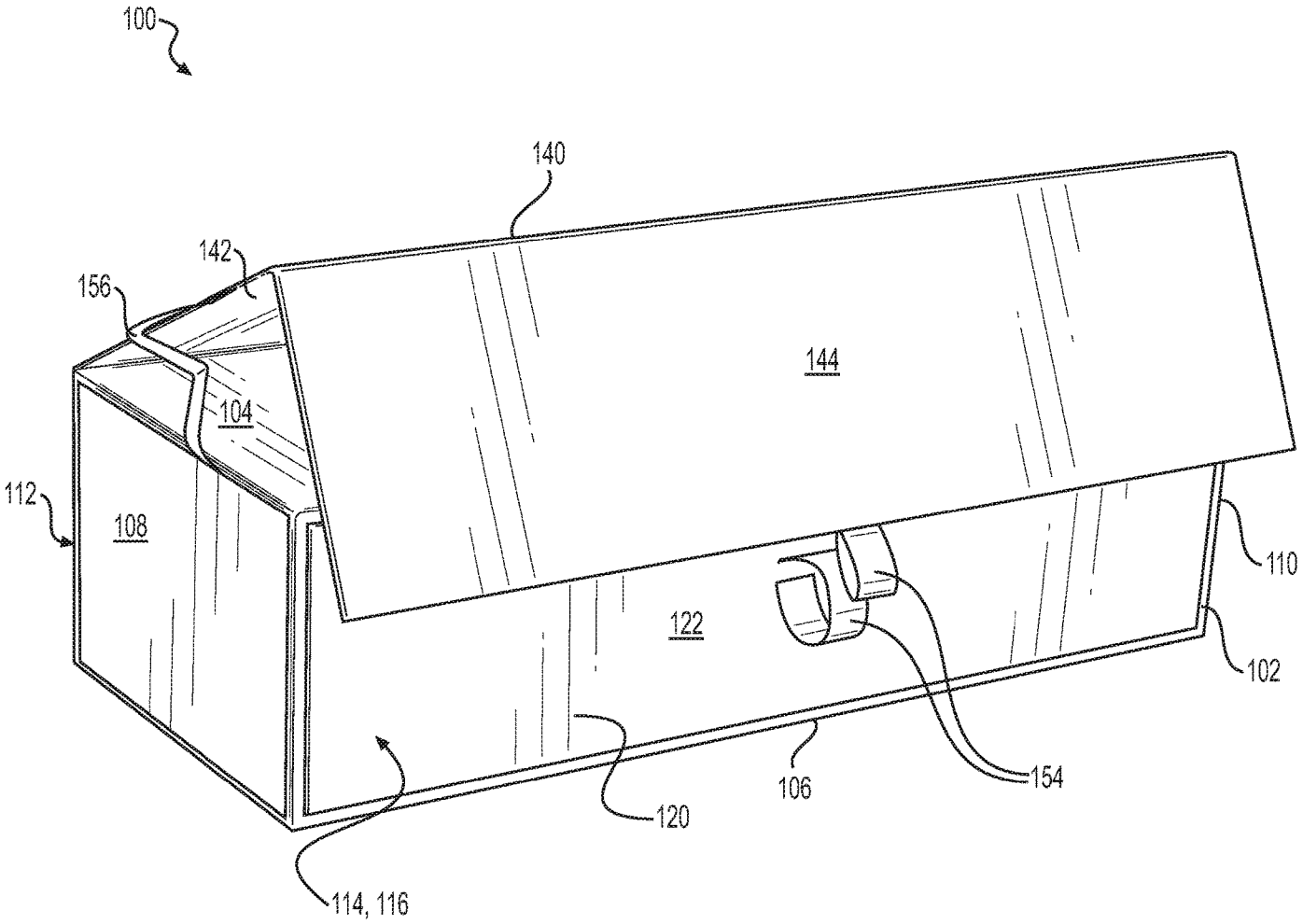
FIG. 2 shows a packaging and display system moving from a closed configuration to an open configuration, in accordance with an example embodiment of the presently disclosed subject matter.

The present disclosure can be understood more readily by reference to the following detailed description of example embodiments and the examples included herein. Before the example embodiments of the devices and methods according to the present disclosure are disclosed and described, it is to be understood that embodiments are not limited to those described within this disclosure. Numerous modifications and variations therein will be apparent to those skilled in the art and remain within the scope of the disclosure. It is also to be understood that the terminology used herein is for the purpose of describing specific embodiments only and is not intended to be limiting. Some embodiments of the disclosed technology will be described more fully hereinafter with reference to the accompanying drawings. This disclosed technology may, however, be embodied in many different forms and should not be construed as limited to the embodiments set forth therein.

In the following description, numerous specific details are set forth. However, it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

By "comprising" or "containing" or "including," it is meant that at least the named compound, element, particle, or method step is present in the composition or article or method, but does not exclude the presence of other compounds, materials, particles, method steps, even if the other such compounds, material, particles, method steps have the same function as what is named.

Throughout this description, various components may be identified having specific values or parameters, however, these items are provided as example embodiments. Indeed, the example embodiments do not limit the various aspects and concepts of the disclosed technology as many comparable parameters, sizes, ranges, and/or values may be implemented. The terms "first," "second," and the like, "primary," "secondary," and the like, do not denote any order, quantity, or importance, but rather are used to distinguish one element from another.

It is noted that terms like "specifically," "preferably," "typically," "generally," and "often" are not utilized herein to limit the scope of the disclosed technology or to imply that certain features are critical, essential, or even important to the structure or function of the disclosed technology. Rather, these terms are merely intended to highlight alternative or additional features that may or may not be utilized in a particular embodiment of the disclosed technology. It is also noted that terms like "substantially" and "about" are utilized herein to represent the inherent degree of uncertainty that may be attributed to any quantitative comparison, value, measurement, or other representation. Also, in describing the example embodiments, terminology will be resorted to for the sake of clarity. It is intended that each term contemplates its broadest meaning as understood by those skilled in the art and includes all technical equivalents that operate in a similar manner to accomplish a similar purpose.

To facilitate an understanding of the principles and features of the embodiments of the present disclosure, example embodiments are explained hereinafter with reference to their implementation in an illustrative embodiment. Such illustrative embodiments are not, however, intended to be limiting.

The materials described hereinafter as making up the various elements of the embodiments of the present disclosure are intended to be illustrative and not restrictive. Many suitable materials that would perform the same or a similar function as the materials described herein are intended to be embraced within the scope of the example embodiments. Such other materials not described herein can include, but are not limited to, materials that are developed after the time of the development of the disclosed technology, for example.

Embodiments of the disclosed technology include a packaging and display system (herein, also referred to as a "container system") that can serve as a container. In some embodiments, the container system can serve as a container for one or more items and/or smaller containers. For example, the container system can be configured to contain and/or aesthetically display one or more self-contained objects. In some embodiments, the objects are smaller containers. In some embodiments, the objects are merchandise. In some embodiments, the objects are smaller containers containing merchandise. In some embodiments, the objects are smaller containers configured to contain merchandise. Merchandise can include, but is not limited to, clothing (e.g., socks, shoes, undergarments, hosiery), candy (e.g., gummy bears, nonpareils, chocolates, cordials, caramels), confectionary/culinary items (e.g., sugar, sprinkles, flour), tea, coffee, cookies, toys (e.g., blind boxes, egg surprises, blind bags, collectible figurines, jewelry), keys, keychains, pin-back buttons, paper goods (e.g., stickers, notepads, stationary, notes, books, recipe notes), make-up, jewelry, gift cards, eyeglasses, sunglasses, utensils, drinkware (e.g., coffee cups, tea cups, shot glasses), small containers of liquid (e.g., alcohol, mixers, soda, massage oil, lotion), baby items (e.g., pacifiers), or any combination thereof. In some embodiments, the container system can be configured to contain and/or aesthetically display a combination of different objects. In some embodiments, the packaging and display system can be configured to receive and/or retain one or more objects (e.g., any of the merchandising mentioned above, such as self-contained candy containers, toys, smaller containers containing any item or merchandise).

Some embodiments can include a plurality of objects. Some embodiments include one or more objects (e.g., 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45). Some embodiments include one or more objects (e.g., 2 or more, 3 or more, 4 or more, 5 or more, 6 or more, 7 or more, 8 or more, 9 or more, 10 or more, 11 or more, 12 or more, 13 or more, 14 or more, 15 or more, 16 or more, 17 or more, 18 or more, 19 or more, 20 or more, 21 or more, 22 or more, 23 or more, 24 or more, 25 or more, 26 or more, 27 or more, 28 or more, 29 or more, 30 or more, 31 or more, 32 or more, 33 or more, 34 or more, 35 or more, 36 or more, 37 or more, 38 or more, 39 or more, 40 or more, 41 or more, 42 or more, 43 or more, 44 or more). Some embodiments include forty-five or less objects (e.g., 2 or less, 3 or less, 4 or less, 5 or less, 6 or less, 7 or less, 8 or less, 9 or less, 10 or less, 11 or less, 12 or less, 13 or less, 14 or less, 15 or less, 16 or less, 17 or less, 18 or less, 19 or less, 20 or less, 21 or less, 22 or less, 23 or less, 24 or less, 25 or less, 26 or less, 27 or less, 28 or less, 29 or less, 30 or less, 31 or less, 32 or less, 33 or less, 34 or less, 35 or less, 36 or less, 37 or less, 38 or less, 39 or less, 40 or less, 41 or less, 42 or less, 43 or less, 44 or less, 45 or less). Some embodiments contain from 1 to 45 objects (e.g., 1-45, 1-40, 1-35, 1-30, 1-25, 1-20, 1-15, 1-10, 1-5, 1-2, 1-3, 1-4, 1-5, 1-6, 1-7, 1-8, 1-9, 1-10, 10-15, 15-20, 20-25, 25-30, 30-35, 35-40, 40-45, 5-15, 15-25, 25-35, 35-45, 10-20, 20-30, 30-40, 3-6, 3-9, 3-12, 2-4, 2-6, 2-8, 2-10, 4-8, 4-16). Some embodiments can include a multiple of the plurality of objects (e.g., 2x, 3x, 4x, 5x, 6x), for example, in embodiments comprising multiple drawers containing the plurality of objects. Those skilled in the art will understand that any number of objects is herein contemplated. In some embodiments, the objects can contain one or more pieces of merchandise (e.g., 300 sprinkles, 25 gummy bears, 2 baby socks, 1 ball). In some embodiments, the objects can contain one or more pieces of merchandise (e.g., 2 or more, 5 or more, 8 or more, 10 or more, 15 or more, 20 or more, 25 or more, 30 or more, 35 or more, 40 or more, 50 or more, 60 or more, 70 or more, 80 or more, 90 or more, 100 or more, 150 or more, 200 or more, 250 or more). In some embodiments, the objects can contain 300 or less pieces of merchandise (e.g., 2 or less, 5 or less, 8 or less, 10 or less, 15 or less, 20 or less, 25 or less, 30 or less, 35 or less, 40 or less, 50 or less, 60 or less, 70 or less, 80 or less, 90 or less, 100 or less, 150 or less, 200 or less, 250 or less, 300 or less). In some embodiments, the objects can contain 1-300 pieces of merchandise (e.g., 1-300, 1-200, 1-150, 1-100, 1-50, 1-25, 1-20, 1-15, 1-10, 1-5, 5-10, 10-15, 15-20, 20-25, 30-35, 35-40, 40-45, 45-50, 10-20, 20-30, 30-40, 40-50, 50-100, 100-150, 150-200, 200-250, 250-300, 200-300, 100-200, 50-150, 150-250, 5-15, 15-25, 25-35, 35-45, 45-55, 55-65, 65-75, 25-50, 15-50, 25-75, 15-75, 40-60, 60-100, 100-125). Any appropriate number of pieces of merchandize is envisioned to appropriately fill the object and/or create the desired aesthetic affect.

Certain embodiments may be configured to be presented, such as in a store, alongside a plurality of objects such that customers may pick an assortment of objects and place them into the packaging and display system. Some embodiments may be configured to snugly receive the objects such that the objects can be removably secured in a predetermined configuration within the packaging and display system. Thus, the packaging and display mechanism can provide an interactive and engaging shopping experience for customers.

In some embodiments, the container system can contain a variety of different objects. In some embodiments, the container system can include a plurality of different objects in the container, wherein each object is a smaller container with different types of candy therein. For example, the container system can include four objects, wherein one object is a smaller container with 30 candy cordials, one object is a shot glass, and one object is a small container of a cocktail mixer, and one is a small container of alcohol. For example, the container system can include nine objects, wherein three are toys (e.g., two blind boxes, and a character ball), three are smaller containers including candy (e.g., gummy bears, chocolates, and nonpareils), two objects are clothing (e.g., gloves), and one object is a make-up case. For example, the container system can contain three objects, one object containing baby socks, one object containing a pacifier, and one objects containing candy. These are non-limiting examples for illustrative purposes.

According to some embodiments and as shown in FIGS. 1-8, a packaging and display system 100 can include a box or container 102. In certain embodiments, the box 102 can have a substantially rectangular cross-section, but not all embodiments are so limited. For example, in some embodiments, the box 102 may have a substantially square cross-section or a substantially triangular cross-section. In certain embodiments, the box 102 may have a cross-section that can be substantially in the shape of a circle, oval, parallelogram, trapezoid, pentagon, hexagon, octagon, or heart. Those skilled in the art will understand that a box 102 having any suitable cross-section shape may be used and is herein contemplated. In some embodiments, the box 102 can have a top 104, a bottom 106, two opposing sides 108, 110, a back 112, and a front face 114. In some embodiments, the box 102 can be hollow, and in some embodiments, the box 102 can have a front face that includes an aperture 116. In some embodiments, the top 104 can include an aperture 116. In certain embodiments, the aperture 116 can be of suitable dimensions to at least partially receive a drawer 120. In some embodiments, the front face 114 of the box 102 can be entirely open, such that the edges of the front face 114 defines an aperture 116 having edges that are defined by the top 104, the bottom 106, and the two opposing sides 108, 110 of the box 102. In some embodiments, the open front face 114 of the box 102 can be of suitable dimensions to at least partially receive a drawer 120. Some embodiments may include multiple drawers 120, such as two, three, four, or more drawers. Some embodiments can contain multiple apertures (e.g., 1, 2, 3, 4, 5, 6, 7, 8, 9, 10, 11, 12, 13, 14, 15, 16, 17, 18, 19, 20, 21, 22, 23, 24, 25). In some embodiment, each aperture can receive one or more drawers (e.g., 1, 2, 3, 4, 5). In some embodiments, the aperture does not contain a drawer. In some embodiments, the aperture can contain one or more objects.

In some embodiments, the drawer 120 can include a front wall 122 and a back wall 124, two opposing side walls 126, 128, a bottom 130, and a top 132. In some embodiments, the top 132 can be fully open. In certain embodiments, the drawer 120 can include one or more cutouts 134 that may extend at least partially into the bottom of the drawer 102. Some embodiments can include an insert 136, and the insert 136 can include cutouts 134. In some embodiments, the cutouts 134 can be a hole (e.g., the cutout 134 can extend fully through the insert 136 or a portion of the drawer 120, such as through top 132 of the drawer 120) or a depression (e.g., the cutout 134 can extend partially into the insert 136 or the bottom 130 of the drawer 120). In certain embodiments, one, some, or all of the cutouts 134 may extend partially through the insert 136, such that one, some, or all of cutouts 134 serve as a recess. Certain embodiments may include one, two, three, four, six, eight, nine, or any other number of cutouts 134 in the drawer 120 and/or insert 136, and the cutouts can correspond with the number of objects to place therein. In some embodiments, one, some, or all of the cutouts may extend entirely through the insert 136. In some embodiments, the length and width of the insert 136 may be substantially equal to an internal length (i.e., the distance between the opposing sides walls 126, 128) and an internal width (i.e., the distance between the front wall 122 and the back wall 124) of the drawer 102. Some embodiments may include one or more separate objects 138, such as toys or self-contained containers of candy. In some embodiments, the shapes and dimensions of the separate objects 138 may correspond to the shapes and dimensions of the cutouts 134. Some embodiments may include multiple cutouts 134, and in some embodiments, the shapes and sizes of the cutouts 134 may be substantially similar, while in other embodiments, the shapes and sizes of the cutouts 134 may differ, such that each cutout 134 corresponds to a particular separate object 138 or a subset of the separate objects 138. In certain embodiments, one, some, or all of the separate objects 138 can, for example and not limitation, be in the shape of a cube, rectangular prism, triangular prism, sphere, egg-shape, or shaped to match any shape topical to a theme of the container system. In certain embodiments, one, some, or all of the separate objects 138 can have a cross-section substantially in the shape of a square, rectangle, circle, oval, parallelogram, trapezoid, pentagon, hexagon, octagon, heart, bow, doll, baby, tube of lipstick, crown, ring, necklace, hat, watch, backpack, shopping bag, birthday cake, ice cream, hamburger, balloon, telephone, mailbox, house, stove, oven, dishwasher, lightning bolt, Christmas tree, menorah, bicycle, tricycle, car, truck, train, plane, boat, rocket, spaceship, flower, tree, animal (such as, but not limited to, a cat, mouse, dog, fish, bird, horse, penguin, monkey, octopus, butterfly, dolphin, whale, camel, elephant, rhinoceros, lion, reindeer, and unicorn), baseball bat, football, shoe, snowman, pumpkin, angel, cloud, star, moon, character (e.g., clown, cartoon, Santa Claus), musical instrument (such as, but not limited to, a saxophone, piano, trumpet, drums, violin, guitar), television, hammer, screwdriver, leaf, plant, or any other suitable shape. In some embodiments, the cutouts 134 can be positioned in a single horizontal row, while in some embodiments, the cutouts 134 can be positioned in a single vertical row. Certain embodiments may include a plurality of cutouts 134 that are arranged in a grid-like pattern including two or more rows and two or more columns. In some embodiments, the cutouts 134 may be offset from one another, such as in a staggered pattern. In certain embodiments, the cutouts 134 can be positioned at various positions in the drawer 120 or the insert 136, without any particular pattern or orientation. In certain embodiments, the cutouts 134 may be arranged to form an image. In some embodiments, the cutouts 134 can have any suitably shaped cross-section, which can include cross-sections substantially in the shape of a square, rectangle, circle, oval, parallelogram, trapezoid, pentagon, hexagon, octagon, heart, bow, doll, baby, tube of lipstick, crown, ring, necklace, hat, watch, backpack, shopping bag, birthday cake, ice cream, hamburger, balloon, telephone, mailbox, house, stove, oven, dishwasher, lightning bolt, Christmas tree, menorah, bicycle, tricycle, car, truck, train, plane, boat, rocket, spaceship, flower, tree, animal (such as, but not limited to, a cat, mouse, dog, fish, bird, horse, penguin, monkey, octopus, butterfly, dolphin, whale, camel, elephant, rhinoceros, lion, reindeer, and unicorn), baseball bat, football, shoe, character (e.g., clown, cartoon, Santa Claus), snowman, pumpkin, birthday cake, angel, cloud, star, moon, clown, musical instrument (such as, but not limited to, a saxophone, piano, trumpet, drums, violin, guitar), television, hammer, screwdriver, leaf, plant, or any other suitable shape.

Certain embodiments may include a flap 140, which may also be referred to as a lid or a top. According to some embodiments, the flap 140 can be hingedly connected to the box 102. In certain embodiments, the flap 140 can be integral with the box 102. In some embodiments, the flap 140 can be separate from the box 102. In some embodiments, the flap 140 can be connected to the box 102 by hinges, such as plastic or metal hinges. In some embodiments, the flap 140 can be hingedly connected to the box 102 at a top-rear edge of the box 102 (i.e., the edge defined by the intersection of the back wall 112 and the top 104). In some embodiments, the flap 140 can have a main portion 142 that substantially complements the top 104 of the box 102 (i.e., the main portion 142 can have a length and a width that can be substantially similar to the length and width of the top 104 of the box 102). In some embodiments, the flap 140 can also include a second portion 144 that substantially complements the front face 114 of the box 104 (i.e., the second portion 144 can have a length and a width that can be substantially similar to the length and the width of the front face 114 of the box 104). In certain embodiments, the second portion 144 of the flap 140 can hinge or pivot in relation to the main portion 142 of the flap 140. In some embodiments, the second portion 144 can be integral with the main portion 142 and can hinge or pivot relative to the main portion 142 via a crease, for example. In some embodiments, the second portion can be separate from the main portion 142. In some embodiments, the second portion 144 can be connected to the main portion 142 by hinges, such as plastic or metal hinges.

Figure 3:
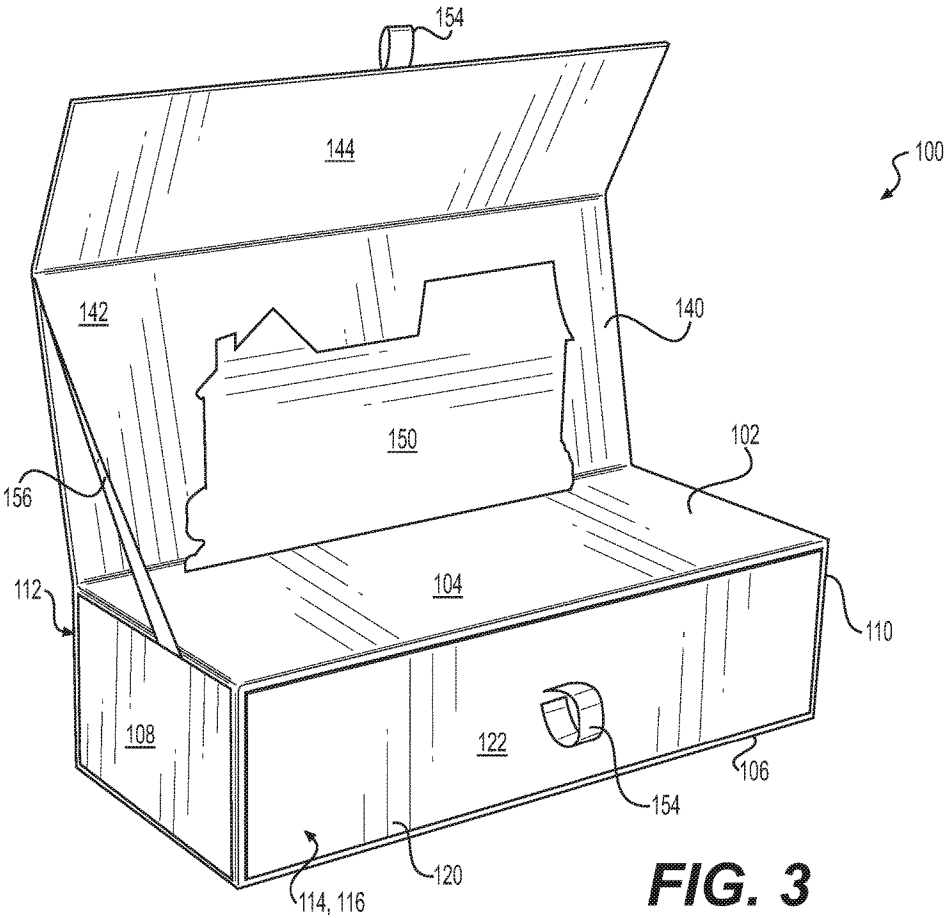
FIG. 3 shows a packaging and display system in an open configuration, in accordance with an example embodiment of the presently disclosed subject matter.
Figure 4:
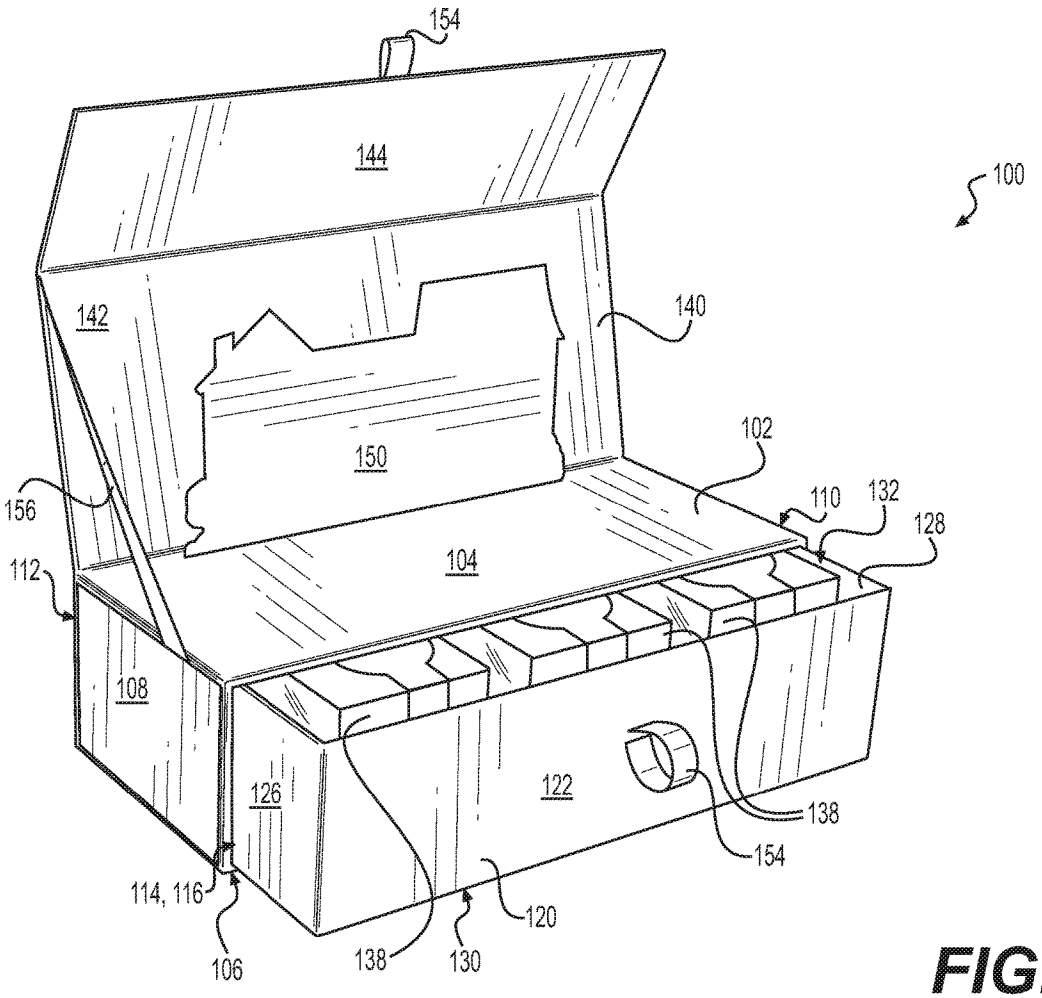
FIG. 4 shows a packaging and display system in an open configuration and a drawer opening, in accordance with an example embodiment of the presently disclosed subject matter.
Figure 5:
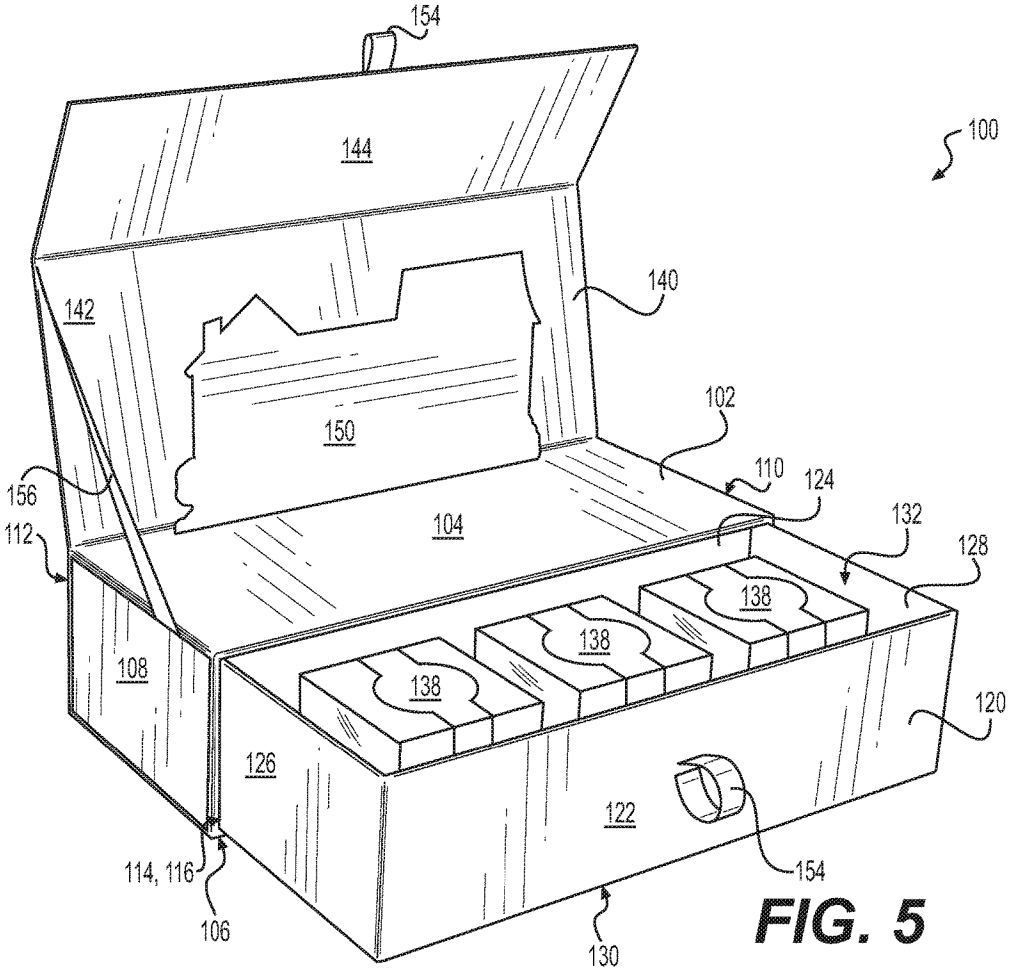
FIG. 5 shows a packaging and display system in an open configuration and a drawer opened, in accordance with an example embodiment of the presently disclosed subject matter.
Figure 6:
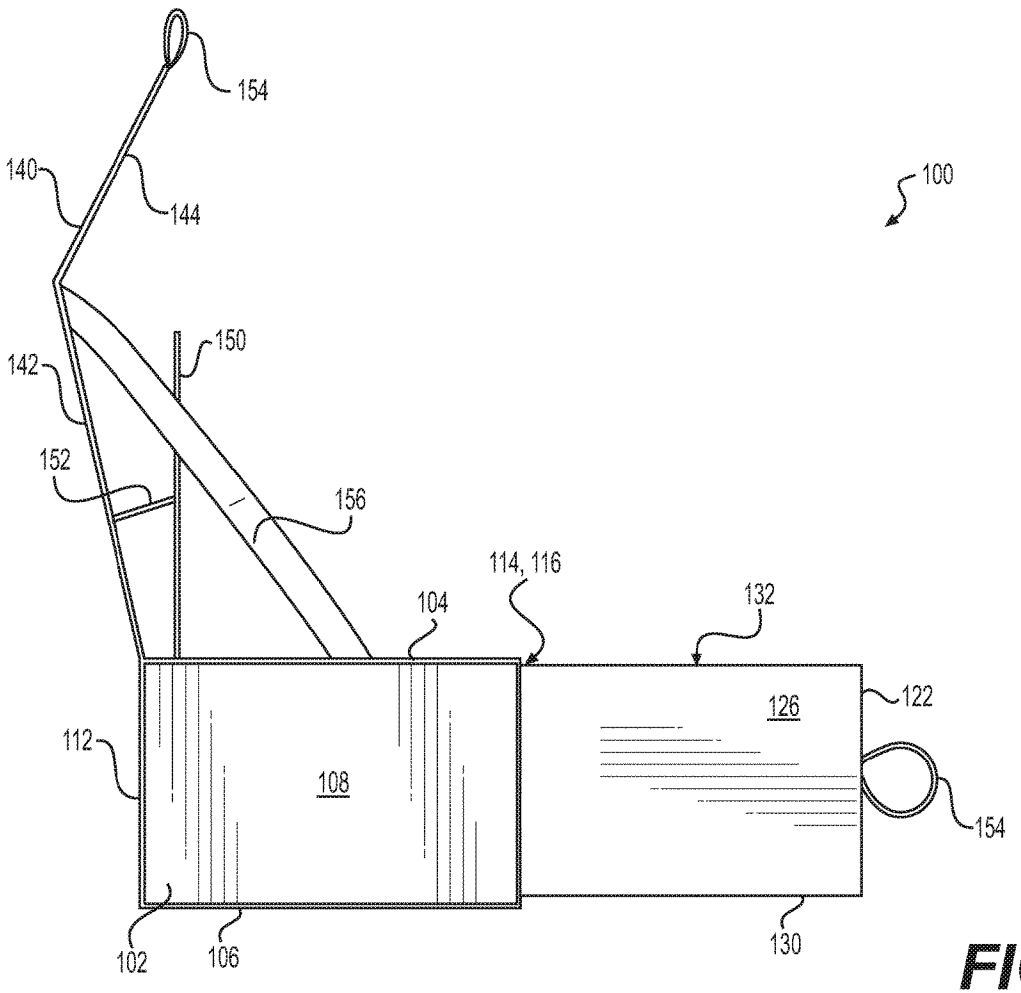
FIG. 6 is a side view of a packaging and display system in an open configuration and a drawer opened, in in accordance with an example embodiment of the presently disclosed subject matter.
Figure 7:
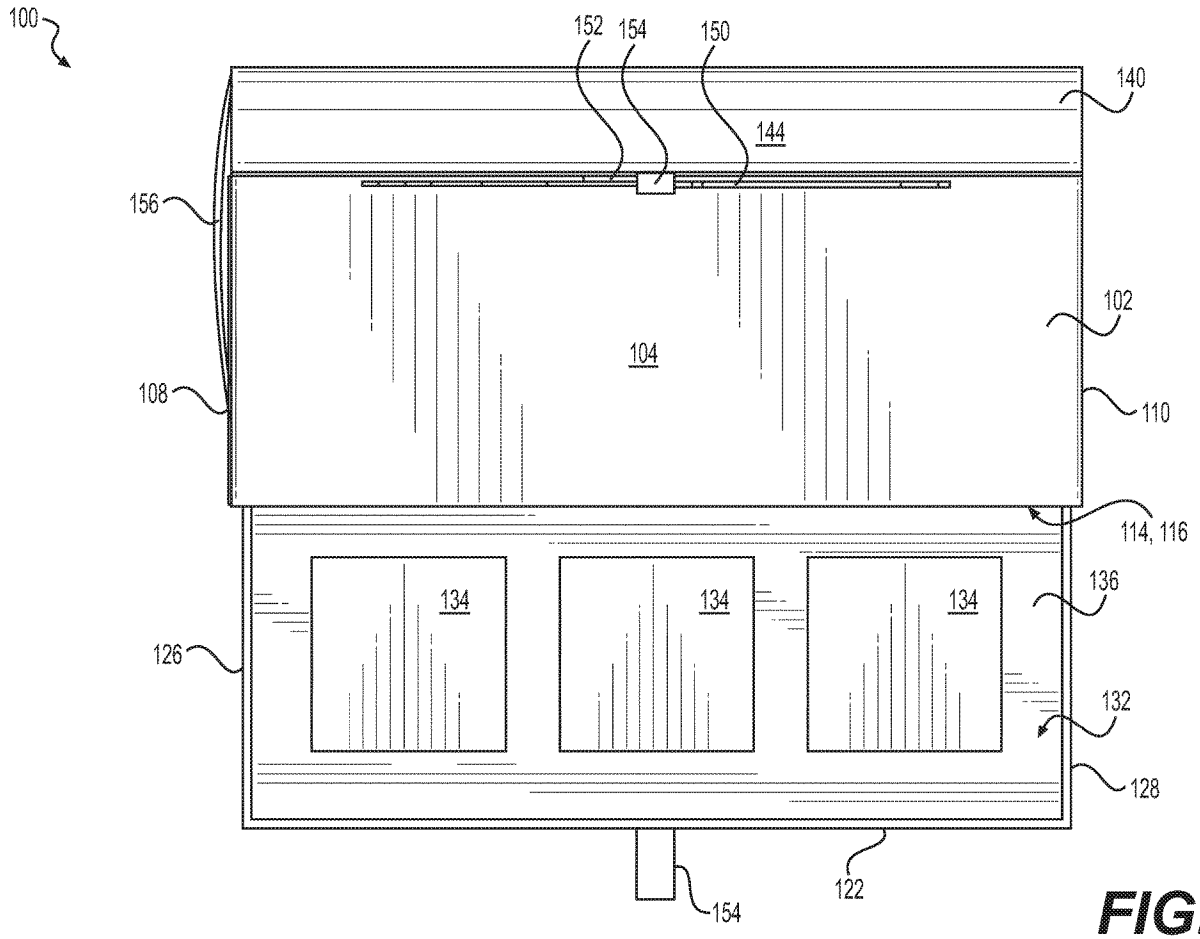
FIG. 7 is a top view of a packaging and display system in an open configuration and a drawer opened, in accordance with an example embodiment of the presently disclosed subject matter.
Figure 8:
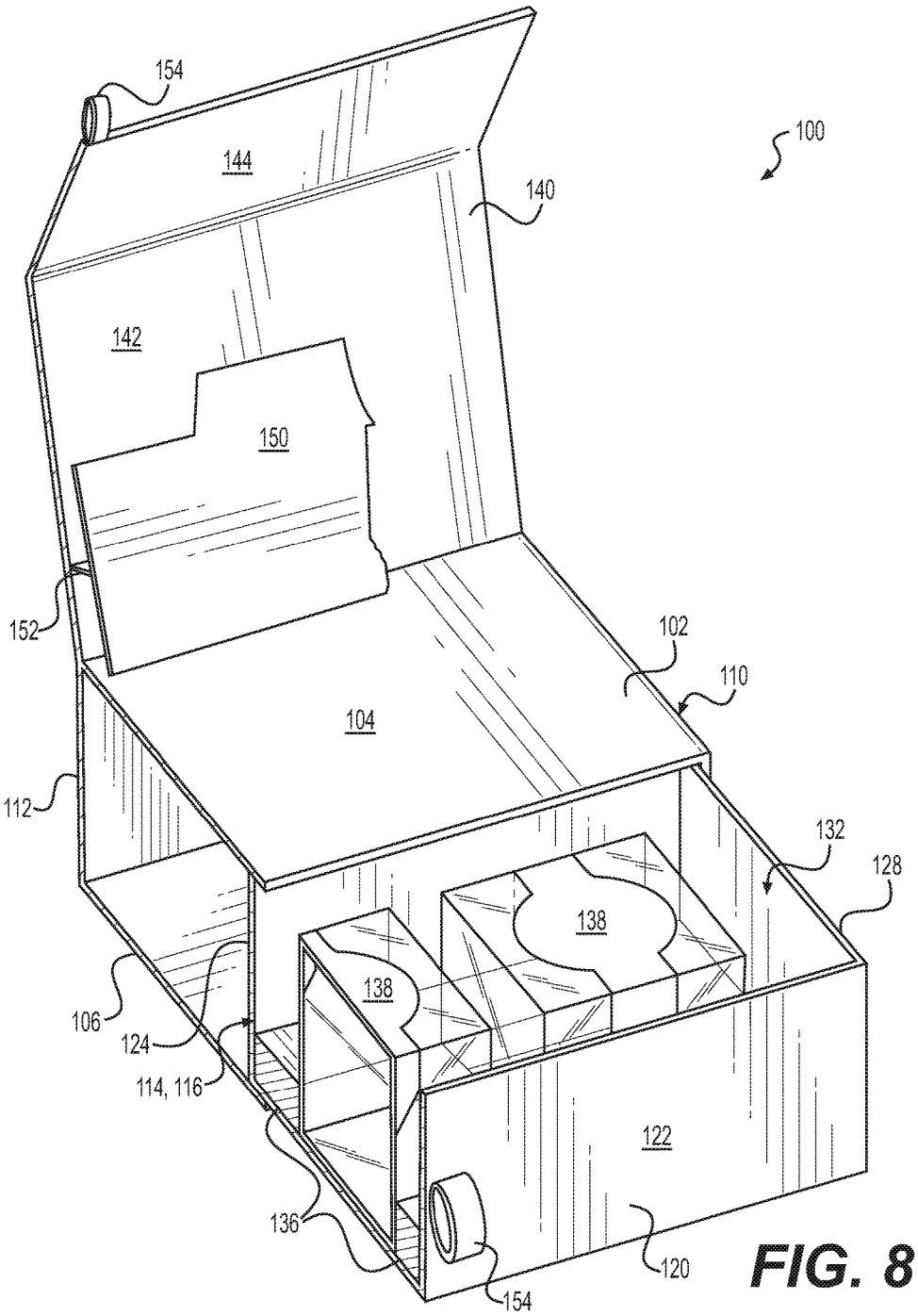
FIG. 8 is a perspective cross-section view of a packaging and display system in an open configuration and a drawer opened, in accordance with an example embodiment of the presently disclosed subject matter.

According to some embodiments, the flap 140 can be configured to move between a closed position (i.e., a storage position), as shown in FIG. 1, and an open position (i.e., a display position), as shown in FIG. 3. In the closed position, the main portion 142 of the flap 140 may be "folded down" such that the main portion 142 can be substantially parallel to the top 104 of the box 102, and the second portion 144 of the flap 140 may be again "folded down" such that the second portion 144 can be substantially parallel to the front face 114 of the box 102.

Some embodiments may include a detachable latching mechanism (not shown) that can temporarily maintain the flap 140 in the closed position. In some embodiments, the latching mechanism can comprise magnets, hook and loop fasteners, and/or any other suitable detachable attachment mechanisms. In some embodiments, a magnet may be positioned on the main portion 142 of the flap 140 and an opposing magnet may be positioned on the top 104 of the box 102 such that the two magnets align when the flap 140 is in the closed position. In some embodiments, a magnet may be positioned on the second flap 144 and an opposing magnet may be positioned on the front 114 of the box 102 and/or on the front 122 of the drawer 120 such that the two magnets align when the flap 140 is in the closed position. Some embodiments may comprise two, three, four, or more of the described aligning magnet pairs. In some embodiments, some or all of the magnet pairs may be replaced with hook and loop fasteners or any other suitable detachable attachment mechanisms. In certain embodiments, one or more magnets can be positioned at least partially within the flap 140 (such as in the main portion 142 and/or the second portion 144), and one or more magnets can be positioned at least partially within the front 114 of the box 102 and/or the front 122 of the drawer 120.

Certain embodiments may include a pop-up portion 150 that can be hingedly connected to the box 102. In some embodiments, the pop-up portion 150 can be a cutout of a regular or irregular shape (or a plurality of shapes) and can include one or more images on the front of the pop-up portion 150. In certain embodiments, a connector member 152 can be hingedly attached to the back of the pop-up portion 150 and can be hingedly attached to the bottom surface of the flap 140. In some embodiments, the connector member 152 can be hingedly attached to the bottom surface of the main portion 142 of the flap 140. In some embodiments, the distance between the attachment point of the pop-up portion 150 to the box 102 and the attachment point of the flap 140 to the box 102 can be substantially similar to the length of the connector member 152. In certain embodiments, the pop-up portion 150 can be sufficiently thin such that, when the flap 140 in the closed position, both the pop-up portion 150 and at least a portion of the flap 140 (such as the main portion 142) may be substantially parallel to the top 104 of the box 102. In some embodiments, the top 104 of the box 102 includes a depression (not shown) that mimics the silhouette of the pop-up portion 150. In certain embodiments, the depth of the depression may be substantially similar to the thickness of the pop-up portion 150 (or the combined thickness of the pop-up portion 150 and the connector member 152) such that, when the flap 140 is in the closed position, the pop-up portion 150 (or the pop-up portion 150 and the connector member 152) folds into the depression, allowing at least a portion of the flap 140 (such as the main portion 142) to be substantially parallel to the top 104 of the box 102. Some embodiments include one or more pop-up portions 150 that pop up when the flap 140 is open. In some embodiments, there are multiple flaps (which can be of different sizes, materials, and shapes). In some embodiments, there are pop-up portions between the different flaps (e.g., two flaps with at least one pop-up portions between the first flap and second flap, between the second flap and the top of the container, or a combination thereof). In some embodiments, there are one or more flaps (e.g., 2 or more, 3 or more, 4 or more, 5 or more, 6 or more, 7 or more, 8 or more, 9 or more, 10 or more, 11 or more, 12 or more, 13 or more, 14 or more, 15 or more, 20 or more, 25 or more, 30 or more, 40 or more). In some embodiments, there are fifty or less flaps (e.g., 2 or less, 3 or less, 4 or less, 5 or less, 6 or less, 7 or less, 8 or less, 9 or less, 10 or less, 11 or less, 12 or less, 13 or less, 14 or less, 15 or less, 20 or less, 25 or less, 30 or less, 40 or less, 50 or less). In some embodiments, some of the flaps are pages (e.g., of a book, greeting card, notes, games, signature page, recipe, or a combination thereof) that contain pop-up portions. In some embodiments, some of the flaps are pages (e.g., of a book, greeting card, notes, games, signature page, recipe, or a combination thereof) that do not contain pop-up portions. In some embodiments, some of the flaps are pages (e.g., of a book, greeting card, notes, games, signature page, recipe, or a combination thereof) that contain pop-up portions while some of the pages do not contain pop-up portions. For example, an embodiment can contain 10 flaps, wherein the top flap includes pop-up portions of a theme (e.g., princess theme), followed by 8 flaps containing a story (e.g., a princess story), followed by a final flap with a greeting card (e.g., "happy birthday, princess") and/or signature page (to have a character princess sign).

Some embodiments may include a stopping mechanism 156. Some embodiments may include two stopping mechanisms 156. In some embodiments, a stopping mechanism 156 can be attached to opposite ends of the flap 140. In some embodiments, the stopping mechanism 156 may limit the angle at which the flap 140 may hinge or pivot relative the top 104 of the box 102. In some embodiments, one end of the stopping mechanism may be attached to the box 102 and an opposite end of the stopping mechanism may be attached to the flap 140. In some embodiments, the stopping mechanism can comprise string, cord, ribbon, cardboard, heavy weighted paper or any other suitable material. In some embodiments, the stopping mechanism can be pulled substantially taught when the flap 140 is in the open position. In some embodiments, the stopping mechanism 156 can be configured to maintain the main portion 142 in a substantially vertical position. In certain embodiments, the stopping mechanism 156 can be configured to maintain the main portion 142 in a position slightly past vertical (relative the top 104 of the box 102). In certain embodiments, the flap 140 can be hinged or pivoted to any one of a plurality of angles between the closed position and the open position. In some embodiments, the stopping mechanism can comprise a portion that extends from the flap such that when the main portion 142 of the flap 140 is substantially vertical (i.e., substantially perpendicular to the top 104 of the box 102), the portion of the stopping mechanism 156 can abut the back 112.

Some embodiments may include one or more tabs 154. For example, in some embodiments, one or more tabs 154 may be positioned on the flap 140, which may assist in moving the flap 140 from the closed position to the open position. In some embodiments, one or more tabs 154 may be positioned on the front 122 of the drawer 120, which may assist in sliding the drawer 120 out of the box 102. In certain embodiments, the tab 154 may comprise string, cord, ribbon, cardboard, heavy weighted paper or any other suitable material. In some embodiments, the tab 154 comprises a loop of material, as shown in FIGS. 1-8.

In some embodiments, the box 102, the flap 140, the drawer 120, the insert 136, and/or one or more of the separate objects 138 may include an image, or a plurality of images, and text. In some embodiments, the images and/or text of the box 102, the flap 140, the drawer 120, the insert 136, and/or one or more of the separate objects s 138 may be topically related to the images, or plurality of images, and/or the silhouette of the pop-up portion 150, and in some embodiments, such a topical relationship may be defined by a central theme, such as a decorative or marketing theme. In some embodiments, the central theme can include holiday themes (e.g., Christmas, Hanukah, Easter, St. Patrick's Day), life-event themes (e.g., wedding, baby shower, bachelor[ette] party, retirement), character themes (e.g., princess, superhero, cartoon, animal character, etc.), greeting card themes (e.g., thank you, get well, congratulations), food/beverage themes (e.g., alcoholic beverages, coffee, tea, cooking), luxury themes (e.g., sunglasses, candy), or a combination thereof. In some embodiments, the text may comprise a meaning, one or more fonts, and/or one or more colors, and in certain embodiments, the meaning, font(s), and color(s) of the text may be topically related to the central theme. In some embodiments, the separate objects 138 may comprise packaging that is topically related to the central theme. In some embodiments, the separate items 138 may include merchandise that is topically related to the central theme. For example, some embodiments may include one or more separate items 138 that comprise candy, and the candy may be colored and/or shaped such that the candy is topically related to the central theme. In certain embodiments, the cutouts or holes 134 may have a cross-section shape that coincides with the central theme, such as a square, rectangle, circle, oval, parallelogram, trapezoid, pentagon, hexagon, octagon, heart, bow, doll, baby, tube of lipstick, crown, ring, necklace, hat, watch, backpack, shopping bag, birthday cake, ice cream, hamburger, balloon, telephone, mailbox, house, stove, oven, dishwasher, lightning bolt, Christmas tree, bicycle, tricycle, car, truck, train, plane, boat, rocket, spaceship, flower, tree, animal (such as, but not limited to, a cat, mouse, dog, fish, bird, horse, penguin, monkey, octopus, butterfly, dolphin, whale, camel, elephant, rhinoceros, lion, reindeer, and unicorn), baseball bat, football, shoe, Santa Claus, snowman, pumpkin, birthday cake, angel, cloud, star, moon, clown, musical instrument (such as, but not limited to, a saxophone, piano, trumpet, drums, violin, guitar), television, hammer, screwdriver, or any other suitable shape.

Some embodiments can include a scent that coincides with the central theme. For example, a packaging and display system 100 that has a central theme related to Christmas may include a pine tree scent. In some embodiments, the scent may be provided by one or more parts of the packaging and display system 100 that are treated with a perfume. In certain embodiments, the scent may be provided by a fragrant coating that releases a scent when it is disturbed, such as by a "scratch and sniff" sticker. Some embodiments may include one or more tags that can be attached directly or indirectly to the box 102, the drawer 120, or the flap 140, for example. In some embodiments, the tag may identify the packaging and display system as a gift to a particular recipient and/or from a particular gift giver. In some embodiments, the tag can include information regarding the separate objects 138 retained within the package and display system 100. In some embodiments, the tag may include other information. In some embodiments, the tag can be topically related to the central them. For example, in some embodiments, the tag can be substantially in the shape of a square, rectangle, circle, oval, parallelogram, trapezoid, pentagon, hexagon, octagon, heart, bow, doll, baby, tube of lipstick, crown, ring, necklace, hat, watch, backpack, shopping bag, birthday cake, ice cream, hamburger, balloon, telephone, mailbox, house, stove, oven, dishwasher, lightning bolt, Christmas tree, bicycle, tricycle, car, truck, train, plane, boat, rocket, spaceship, flower, tree, animal (such as, but not limited to, a cat, mouse, dog, fish, bird, horse, penguin, monkey, octopus, butterfly, dolphin, whale, camel, elephant, rhinoceros, lion, reindeer, and unicorn), baseball bat, football, shoe, Santa Claus, snowman, pumpkin, birthday cake, angel, cloud, star, moon, clown, musical instrument (such as, but not limited to, a saxophone, piano, trumpet, drums, violin, guitar), television, hammer, screwdriver, or any other suitable shape.

Some embodiments can include a music clip that coincides with the central theme. For example, a packaging and display system 100 that has a central theme related to a character (e.g., a princess, superhero) may include a related theme song. For example, a packaging and display system 100 that has a central theme related to Christmas may include a Christmas song. In some embodiments, the music clip activates when the flap opens. In some embodiments, the music clip activates when the drawer opens. In some embodiments, the container assembly is configured as a music box.

Some embodiments may include multiple flaps 140, and the multiple flaps 140 may be positioned such that they resemble a book. Some embodiments may include multiple pop-up portions 150. In some embodiments, one or more pop-portions 150 may be hingedly attached to multiple flaps 140. In some embodiments, a separate pop-up portion 150 may be attached to one, some, or all of the flaps 140. In some embodiments, the flaps 140 and/or the pop-up portions 150 may tell a story or assist in telling a story. In some embodiments, the story can be topically related to the central theme. In certain embodiments, a final flap 140 may be configured to cover and/or reveal a void in the box 102. The void may include one or more cutouts 134 such that separate objects 138 may be retained. In certain embodiments, the packaging and display system 100 may include a void in addition to a drawer 120. In some embodiments, the packaging and display system 100 may include a void in lieu of a drawer 120.

Embodiments of the disclosed technology may be composed of any material, or any combination of materials, providing a suitable structural integrity. For example, the box 102, the flap 140, the drawer 120, the insert 136, the pop-up portion 150, and/or the connector member 152 may comprise metal, plastic, wood, cardboard, corrugated cardboard, heavy-weighted paper, or any combination thereof. Again, those skilled in the art will understand that the preceding list of materials is non-exhaustive, and any material, or combination of materials, that provides a suitable structural integrity to achieve the purposes described herein is contemplated.

It is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container system comprising:

a container comprising a front face, the front face comprising an aperture;

a flap hingedly connected to the container, the flap comprising a first portion dimensioned to substantially complement a top surface of the container and a second portion dimensioned to substantially complement the front face of the container, the second portion configured to hinge relative to the first portion;

a pop-up portion hingedly connected to the container, the pop-up portion in communication with the flap such that the pop-up portion is caused to pivot as the flap pivots; and a drawer comprising an insert, the insert comprising a cutout, and the cutout extending at least partially into the insert, wherein the aperture is configured to at least partially receive the drawer.

2. The container system of claim 1, further comprising an object, wherein the cutout is configured to at least partially receive the object.

3. The container system of claim 1, wherein the cutout is a first cutout, and the drawer further comprises a second cutout, the second cutout extending at least partially into the insert.

4. The container system of claim 3, further comprising a first object and a second object, wherein the first cutout is configured to at least partially receive the first object and the second cutout is configured to at least partially receive the second object.

5. The container system of claim 1, wherein the pop-up portion is hingedly connected to a top surface of the container and the flap is hingedly connected proximate a top-rear edge of the container.

6. The container system of claim 1, further comprising a latching mechanism configured to detachably attach the second portion of the flap to a front side of the drawer.

7. The container system of claim 1, further comprising a latching mechanism configured to detachably attach the second portion of the flap to the front face of the container.

8. The container system of claim 1, wherein the flap and the pop-up portion are configured to hinge between a storage configuration and a display configuration, wherein when in the storage configuration, the flap and the pop-up portion are hinged such that the pop-up portion, the flap, or a combination thereof are substantially parallel to a top surface of the container, and wherein when in the display configuration, the flap and the pop-up portion are hinged such that at least one of the pop-up portion and the flap are not substantially parallel to the top surface.

9. The container system of claim 1, further comprising a stop mechanism, the stop mechanism configured to prevent rotation of the flap and/or the pop-up portion beyond a maximum angle.

10. The container system of claim 1, wherein the second portion comprises a first magnet, wherein a front side of the drawer comprises a second magnet, and wherein the first magnet and the second magnet are positioned to substantially align when the container system is in the storage configuration.

11. The container system of claim 1, wherein at least one of the drawer and the flap comprises a tab.

12. The container system of claim 1, further comprising an image located on an exterior surface of the container, wherein the image is topically related to the pop-up portion.

13. A packaging and display system comprising:

a box comprising a top, a bottom, two opposing sides, a back, and an open face;

a flap hingedly connected to the box proximate an edge formed by the top and the back, the flap comprising a first portion dimensioned to substantially complement the top of the box and a second portion dimensioned to substantially complement the open face of the box, the second portion configured to hinge relative to the first portion, wherein the flap can pivot between (i) a closed position in which the first portion is substantially parallel to the top and the second portion substantially covers the open face and (ii) an open position;

a pop-up portion hingedly connected to the top;

a connector member hingedly attached to a back side of the pop-up portion and hingedly connected to a bottom side of the flap;

a drawer configured to at least partially insert into the open face, the drawer comprising a cutout.

14. The packaging and display system of claim 13, wherein the drawer comprises an insert, the insert comprising the cutout.

15. The packaging and display system of claim 13, wherein the pop-up portion is hingedly connected to the top at a first position and the flap is hingedly connected to the box at a second position, the first position being a distance from the second position, wherein the connector member has a length, and wherein the distance is approximately equal to the length.

16. The packaging and display system of claim 13, further comprising an image, the image being topically related to the pop-up portion.

17. The packaging and display system of claim 13, further comprising an object, wherein the cutout is configured to at least partially receive the object.

18. The packaging and display system of claim 13, wherein the cutout is a first cutout and the drawer further comprises a second cutout.

19. The packaging and display system of claim 18, further comprising a first object and a second object, wherein the first cutout is configured to at least partially receive the first object and the second cutout is configured to at least partially receive the second object.

* * * * *